US012404569B2

(12) United States Patent
Luo et al.

(10) Patent No.: US 12,404,569 B2
(45) Date of Patent: Sep. 2, 2025

(54) MAGNESIUM ALLOYS AND METHODS OF MAKING AND USE THEREOF

(71) Applicant: Ohio State Innovation Foundation, Columbus, OH (US)

(72) Inventors: Aihua Luo, Westerville, OH (US); Renhai Shi, Beijing (CN)

(73) Assignee: Ohio State Innovation Foundation, Columbus, OH (US)

( * ) Notice: Subject to any disclaimer, the term of this patent is extended or adjusted under 35 U.S.C. 154(b) by 556 days.

(21) Appl. No.: 17/764,389

(22) PCT Filed: Sep. 28, 2020

(86) PCT No.: PCT/US2020/053065
§ 371 (c)(1),
(2) Date: Mar. 28, 2022

(87) PCT Pub. No.: WO2021/067182
PCT Pub. Date: Apr. 8, 2021

(65) Prior Publication Data

US 2022/0341006 A1 Oct. 27, 2022

Related U.S. Application Data

(60) Provisional application No. 62/908,077, filed on Sep. 30, 2019.

(51) Int. Cl.

| | |
|---|---|
| ***C22C 23/04*** | (2006.01) |
| ***C22C 23/00*** | (2006.01) |
| ***C22C 23/02*** | (2006.01) |
| ***C22F 1/06*** | (2006.01) |

(52) U.S. Cl.
CPC ..... *C22C 23/04* (2013.01); *C22C 23/00* (2013.01); *C22C 23/02* (2013.01); *C22F 1/06* (2013.01)

(58) Field of Classification Search
CPC ..... C22C 23/00; C22C 23/02; C22C 23/04; C22F 1/06
See application file for complete search history.

(56) References Cited

U.S. PATENT DOCUMENTS

| | | | | |
|---|---|---|---|---|
| 5,855,697 | A | 1/1999 | Luo et al. | |
| 2002/0102179 | A1 | 8/2002 | Murai et al. | |
| 2009/0116994 | A1 | 5/2009 | Luo et al. | |
| 2014/0238192 | A1* | 8/2014 | Otsuka | C22C 23/00 420/407 |
| 2019/0085433 | A1 | 3/2019 | Sung et al. | |

FOREIGN PATENT DOCUMENTS

| | | | | |
|---|---|---|---|---|
| CN | 108385008 A | * | 8/2018 | B21C 25/02 |
| CN | 110066948 B | * | 7/2019 | C22C 1/02 |
| WO | 2014145672 A1 | | 9/2014 | |
| WO | 2017112779 A1 | | 6/2017 | |
| WO | 2021040988 A1 | | 3/2021 | |

OTHER PUBLICATIONS

English Abstract and English Machine Translation of Dai et al. (CN 110066948 B) (Jul. 30, 2019).*
English Abstract and English Machine Translation of Chen (CN 108385008 A) (Aug. 10, 2018).*
Atwell, D.L. and Barnett, M.R., 2007. Extrusion limits of magnesium alloys. Metallurgical and Materials Transactions A, 38(12), pp. 3032-3041.
Lei et al. Comparison of the Strain Rate Sensitivity in AZ31 and WE43 Magnesium Alloys under Different Loading Conditions, Crystals, 2023, 13, 554.
Luo AA et al. Creep and microstructure of magnesium-aluminum-calcium based alloys. Metall. Mater. Trans. A 33(3), 567 (2002).
Shi R et al. A new magnesium sheet alloy with high tensile properties and room-temperature formability. Sci. Rep. 10 (1), 1 (2020).
Zehnder C et al. Plastic deformation of single crystalline C14 Mg2Ca Laves phase at room temperature. Mater. Sci. Eng. A, 2019, 759, 754.
Zhong Y et al. Laves Phases in Mg—Al—Ca Alloys, Magnesium Technology, 2004, pp. 317-323.
International Search Report and Written Opinion, issued by the International Searching Authority (ISA/US) in PCT Application No. PCT/US2020/053065 on Dec. 15, 2020. 10 pages.
Bian et al. "A heat-treatable Mg—Al—Ca—Mn—Zn sheet alloy with good room temperature formability," Scripta Materialia, 2017, 138, 151-155.
Liu et al. "Designing Mg alloys with high ductility: Reducing the strength discrepancies between soft deformation modes and hard deformation modes," Acta Materialia, 2017, 141, 1-9.
Luo et al. "High-ductility magnesium-zinc-cerium extrusion alloys," Scripta Materialia, 2011, 64, 410-413.
Luo, "Recent magnesium alloy development for elevated temperature applications", International Materials Reviews 2004, 49(1), 13-30.
Luo, AA. "Material design and development: From classical thermodynamics to CALPHAD and ICME approaches," CALPHAD, 2015, 50, 6-22.
Robson et al. "Particle effects on recrystallization in magnesium-manganese alloys: Particle-stimulated nucleation," Acta Materialia 2009, 57(9), 2739-2747.
Sandlöbes et al. "The relation between ductility and stacking fault energies in Mg and Mg—Y alloys," Acta Materialia 2012, 60, 3011-3021.

(Continued)

*Primary Examiner* — Jessee R Roe
(74) *Attorney, Agent, or Firm* — Meunier Carlin & Curfman LLC

(57) ABSTRACT

Disclosed herein are magnesium alloys and methods of making and use thereof. The magnesium alloys comprise: from 1 to 1.5 wt % Zn, from 1 to 1.4 wt. % Al, from 0.2 to 0.7 wt % Ca, from 0.2 to 0.4 wt % Ce, from 0.1 to 0.8 wt % Mn, and the balance comprising Mg.

17 Claims, 7 Drawing Sheets

(56) References Cited

OTHER PUBLICATIONS

Sasaki et al. "Strong and ductile heat-treatable Mg—Sn—Zn—Al wrought alloys," Acta Materialia 2015, 99, 176-186.
Xu et al. "High-strength extruded Mg—Al—Ca—Mn alloys." Scripta Materialia 2011, 65(3), 269-272.
Zeng et al. "Texture evolution during static recrystallization of cold-rolled magnesium alloys," Acta Materialia, 2016, 105, 479-494.
Zeng et al. "Achieving exceptionally high strength in Mg—3Al—1Zn—0.3Mn extrusions via suppressing intergranular deformation," Acta Materialia 2018, 160, 97-108.
Zhang et al. "Enhanced mechanical properties in fine-grained Mg—1.0Zn—0.5Ca alloys prepared by extrusion at different temperatures," Scripta Materialia 2010, 63(10), 1024-1027.

* cited by examiner

MAGNESIUM ALLOYS AND METHODS OF MAKING AND USE THEREOF

CROSS REFERENCE TO RELATED APPLICATIONS

This application is a U.S. National Stage application filed under 35 U.S.C. § 371 of PCT/US2020/053065 filed Sep. 28, 2020, which claims the benefit of priority to U.S. Provisional Application No. 62/908,077, filed Sep. 30, 2019, each of which is hereby incorporated herein by reference in its entirety.

STATEMENT OF GOVERNMENT SUPPORT

This invention was made with government support under Grant No. DE-EE0007756 awarded by the Department of Energy. The government has certain rights in the invention.

BACKGROUND

Magnesium (Mg), the lightest structural metal, and its alloys with high specific strength and low density are promising lightweight materials for industrial applications in automotive, aerospace, and electronic sectors. However, compared to commercial aluminum alloys and steels, there are only limited applications of Mg alloys owing to their low strength, poor ductility, and poor formability at room temperature. Thus, there is an urgent need to improve the mechanical performance of Mg sheet alloys at room temperature, especially for high-volume industrial applications such as the automotive market. The compositions, methods, and systems discussed herein addresses these and other needs.

SUMMARY

In accordance with the purposes of the disclosed compositions, methods, and systems as embodied and broadly described herein, the disclosed subject matter relates to magnesium alloys and methods of making and use thereof.

For example, disclosed herein are magnesium alloys comprising: from 1 to 1.5 wt. % Zn, from 1 to 1.4 wt. % Al, from 0.2 to 0.7 wt. % Ca, from 0.2 to 0.4 wt. % Ce, from 0.1 to 0.8 wt. % Mn, and the balance comprising Mg. In some examples, the magnesium alloy comprises from 1 to 1.25 wt. % Zn. In some examples, the magnesium alloy comprises 1 wt. % Zn. In some examples, the magnesium alloy comprises from 1 to 1.2 wt. % Al. In some examples, the magnesium alloy comprises 1 wt. % Al. In some examples, the magnesium alloy comprises from 0.2 to 0.5 wt. % Ca. In some examples, the magnesium alloy comprises 0.3 wt. % Ca. In some examples, the magnesium alloy comprises from 0.2 to 0.3 wt. % Ce. In some examples, the magnesium alloy comprises 0.2 wt. % Ce. In some examples, the magnesium alloy comprises from 0.2 to 0.6 wt. % Mn. In some examples, the magnesium alloy comprises 0.4 wt. % Mn. In some examples, the magnesium alloy comprises from 1 to 1.25 wt. % Zn, from 1 to 1.2 wt. % Al, from 0.2 to 0.5 wt. % Ca, from 0.2 to 0.3 wt. % Ce, from 0.2 to 0.6 wt. % Mn, and the balance comprising Mg. In some examples, the magnesium alloy comprises 1 wt. % Zn, 1 wt. % Al, 0.3 wt. % Ca, 0.2 wt. % Ce, 0.4 wt. % Mn, and the balance comprising Mg. In some examples, the Zn, Al, Ca, Ce, and Mn are substantially dissolved in the magnesium alloy. In some examples, the magnesium alloy is microalloyed. In some examples, the magnesium alloy has an average grain size of from 5 μm to 14 μm.

The magnesium alloy can, for example, have a high strength. In some examples, the magnesium alloy has a yield strength of 200 MPa or more, 225 MPa or more, or 250 MPa or more.

The magnesium alloy can, for example, have a high ductility. In some examples, the magnesium alloy has an elongation to failure of 25% or more, 28% or more, 30% or more.

In some examples, the magnesium alloy is formable at room temperature. In some examples, the magnesium alloy has an Index Erichsen value of 6 mm or more, 7 mm or more, or 8 mm or more at room temperature.

Also described herein are objects comprising the magnesium alloys described herein. Also described herein are sheets comprising the magnesium alloys described herein, wherein the sheets can have an average thickness of from 0.5 mm to 5 mm, from 0.8 mm to 2 mm, or from 0.8 mm to 1.5 mm. Also described herein are articles of manufacture comprising the magnesium alloys described herein, the objects described herein, or the sheets described herein.

Also described herein are methods of use of the magnesium alloys described herein, the objects described herein, the sheets described herein, or the articles of manufacture described herein, the method comprising using the magnesium alloy, the object, or the sheet in an automotive, aerospace, or electronic application.

Also described herein are methods of making a magnesium alloy based object comprising the magnesium alloys described herein, the methods of making the magnesium alloy based object comprising: heating an object comprising a preliminary magnesium alloy at a first temperature for a first amount of time; wherein the preliminary magnesium alloy comprises a first intermetallic phase having a melting temperature, a second intermetallic phase having a melting temperature, a third intermetallic phase having a melting temperature, and an alloy phase having a solidus temperature; wherein the melting temperature of the first intermetallic phase is lower than the melting temperature of the second intermetallic phase, the melting temperature of the third intermetallic phase, and the solidus temperature of the alloy phase; wherein the melting temperature of the second intermetallic phase is lower than the melting temperature of the third intermetallic phase and the solidus temperature of the alloy phase; wherein the melting temperature of the third intermetallic phase is higher than the solidus temperature of the alloy phase; wherein the first temperature is above the melting temperature of the first intermetallic phase, below the melting temperature of the second intermetallic phase, below the melting temperature of the third intermetallic phase, and below the solidus temperature of the alloy phase; thereby substantially dissolving the first intermetallic phase into the alloy phase to form an object comprising a first intermediate magnesium alloy, the first intermediate magnesium alloy comprising the second intermetallic phase, the third intermetallic phase, and the alloy phase; heating the object comprising the first intermediate magnesium alloy at a second temperature for a second amount of time; wherein the second temperature is above the melting temperature of the second intermetallic phase, below the melting temperature of the third intermetallic phase, and below the solidus temperature of the alloy phase; thereby substantially dissolving the second intermetallic phase into the alloy phase to form an object comprising a second intermediate magnesium alloy, the second intermediate magnesium alloy comprising the third intermetallic phase and the alloy phase; and heating the object comprising the second intermediate magnesium alloy at a third temperature for a third amount of time; wherein the third temperature is above the melting temperature of the third intermetallic phase; thereby substantially dissolving the third intermetallic phase into the alloy phase and minimizing incipient melting of the alloy phase to form the magnesium alloy based object. In some examples, the methods further comprise determining the first temperature, the first amount of time, the second temperature, the second amount of time, the third temperature, the third amount of time, or a combination thereof.

In some examples, the first temperature is from 10° C. to 200° C. above the melting temperature of the first intermetallic phase. In some examples, the first temperature is from 250° C. to 325° C. (e.g., from 300° C. to 325° C.). In some examples, the first temperature is 320° C. In some examples, the first amount of time is from 1 hour to 24 hours, from 2 hours to 20 hours, from 3 hours to 18 hours, or from 4 hours to 16 hours.

In some examples, the second temperature is from 10° C. to 120° C. above the melting temperature of the second intermetallic phase. In some examples, the second temperature is from 325° C. to 450° C. (e.g., from 430° C. to 450° C.). In some examples, the second temperature is 440° C. In some examples, the second amount of time is from 1 hour to 24 hours, from 2 hours to 20 hours, from 3 hours to 18 hours, or from 4 hours to 16 hours.

In some examples, the third temperature is from 10° C. to 50° C. above the melting temperature of the third intermetallic phase. In some examples, the third temperature is from 450° C. to 500° C. (e.g., from 460° C. to 500° C.). In some examples, the third temperature is 480° C.

In some examples, the third amount of time is from 0.1 hours to 3 hours, 0.2 hours to 2.4 hours, or from 0.3 hours to 2 hours.

In some examples, the first intermetallic phase comprises $Al_4Mn$, $Ca_2Mg_5Zn_5$, $Al_{11}Mn_4$, or a combination thereof. In some examples, the second intermetallic phase comprises $Al_2Ca$. In some examples, the third intermetallic phase comprises AlCaMg.

In some examples, the magnesium alloy based object comprises a substantially homogeneous matrix comprising the alloy phase.

In some examples, the methods further comprise thermomechanically treating the magnesium alloy based object by heating the magnesium alloy based object at a fourth temperature for a fourth amount of time and, subsequently, mechanically treating the magnesium alloy based object. In some examples, the methods further comprise repeating the thermomechanical treatment. In some examples, the magnesium alloy based object exhibits improved mechanical properties after thermomechanical treatment. In some examples, the magnesium alloy based object exhibits improved yield strength and/or ductility after thermomechanical treatment.

In some examples, the fourth temperature is above room temperature and below the solidus temperature. In some examples, the fourth temperature is from 10° C. to 250° C. below the solidus temperature. In some examples, the fourth temperature is from 350° C. to 550° C. In some examples, the fourth temperature is 450° C. In some examples, the fourth amount of time is from 1 minute to 1 hour, from 1 minute to 30 minutes, or from 1 minute to 10 minutes. In some examples, the fourth amount of time is 5 minutes. In some examples, the methods further comprise determining the fourth temperature and/or the fourth amount of time.

In some examples, mechanically treating the magnesium alloy based object comprises rolling the magnesium alloy based object. In some examples, the magnesium alloy based object has an average thickness and rolling the magnesium alloy based object reduces the average thickness of the magnesium alloy based object. In some examples, the average thickness of the magnesium alloy based object is reduced by 1% to 85%. In some examples, mechanically treating the magnesium alloy based object comprises extrusion and/or forging.

In some examples, the methods further comprise casting the object comprising the preliminary magnesium alloy. In some examples, the methods further comprise determining the composition of the preliminary magnesium alloy and/or the magnesium alloy. In some examples, the methods further comprise determining the amount of Zn to include in the magnesium alloy, the amount of Al to include in the magnesium alloy, the amount of Ca to include in the magnesium alloy, the amount of Ce to include in the magnesium alloy, the amount of Mn to include in the magnesium alloy, or a combination thereof.

Also described herein are magnesium alloy based objects made by the methods described herein. In some examples, the magnesium alloy based object has a yield strength of 200 MPa or more, 225 MPa or more, or 250 MPa or more. In some examples, the magnesium alloy an elongation to failure of 25% or more, 28% or more, 30% or more. In some examples, the magnesium alloy based object has an Index Erichsen value of 6 mm or more, 7 mm or more, or 8 mm or more at room temperature. In some examples, the magnesium alloy based object has an average thickness of from 0.5 mm to 5 mm, from 0.8 mm to 2 mm, or from 0.8 mm to 1.5 mm. In some examples, the magnesium alloy has an average grain size of from 5 μm to 14 μm. Also described herein are methods of use of the magnesium alloy based objects described herein, the method comprising using the magnesium alloy based object in an automotive, aerospace, or electronic application. Also described herein are articles of manufacture comprising the magnesium alloy based objects described herein.

Additional advantages of the disclosed compositions, systems, and methods will be set forth in part in the description which follows, and in part will be obvious from the description.

The advantages of the disclosed compositions, systems, and methods will be realized and attained by means of the elements and combinations particularly pointed out in the appended claims. It is to be understood that both the foregoing general description and the following detailed description are exemplary and explanatory only and are not restrictive of the disclosed systems and methods, as claimed.

The details of one or more embodiments of the invention are set forth in the accompanying drawings and the description below. Other features, objects, and advantages of the invention will be apparent from the description and drawings, and from the claims.

BRIEF DESCRIPTION OF THE FIGURES

The accompanying figures, which are incorporated in and constitute a part of this specification, illustrate several aspects of the disclosure, and together with the description, serve to explain the principles of the disclosure.

DETAILED DESCRIPTION

Figure 1:
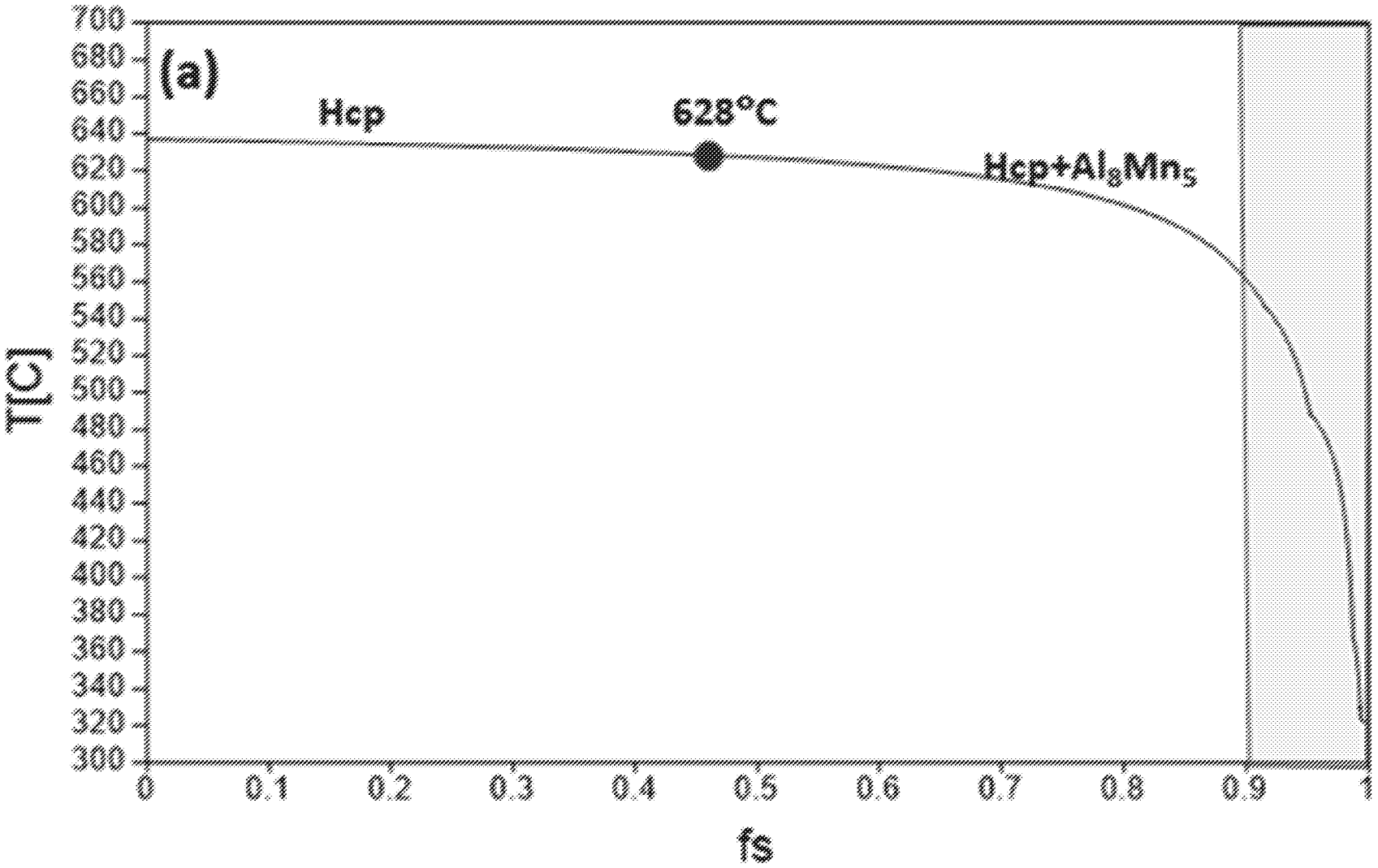
FIG. 1 shows the solidification path of ZAXEM11100.
Figure 2:
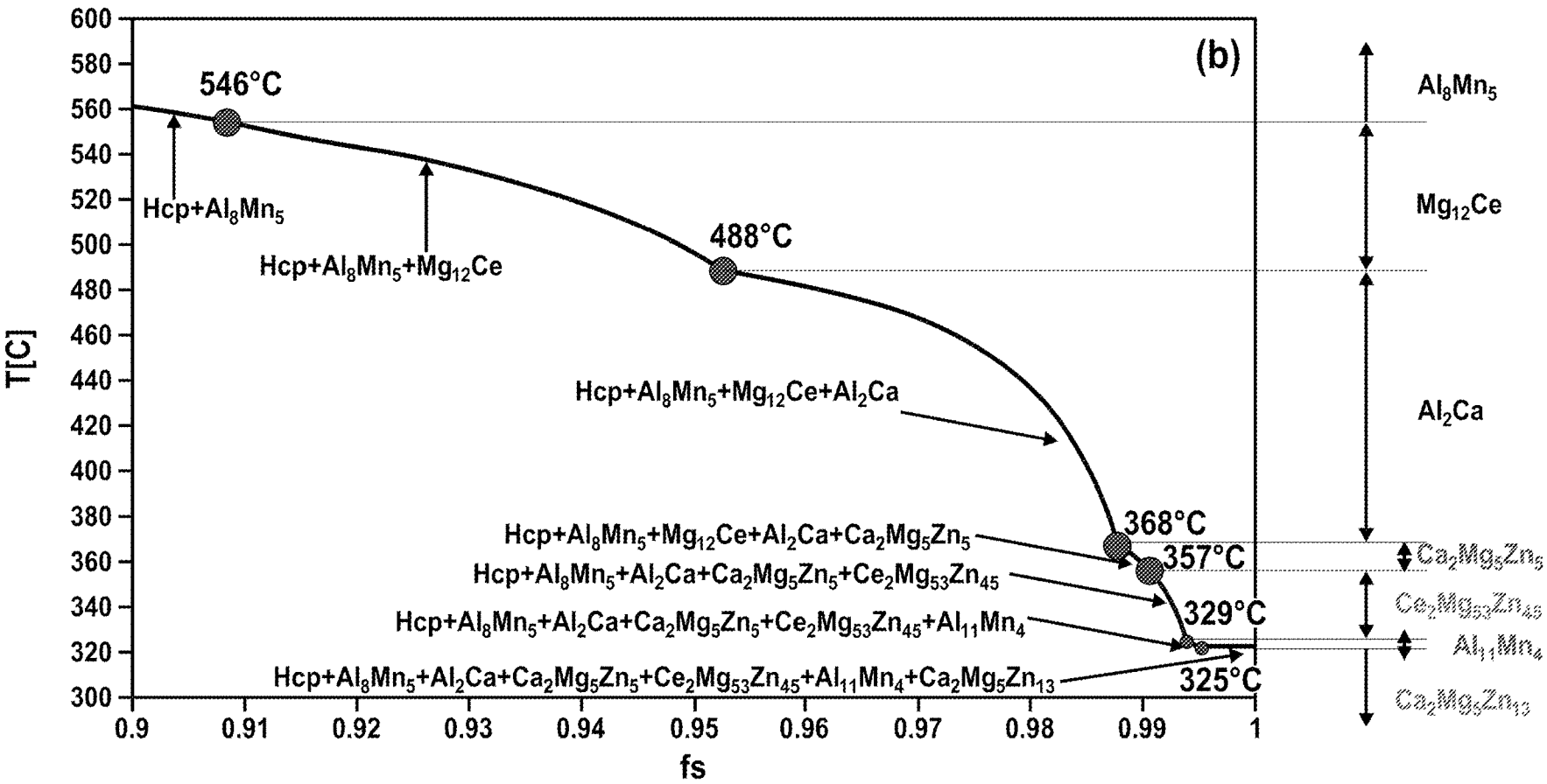
FIG. 2 is an enlarged region from FIG. 1.
Figure 3:
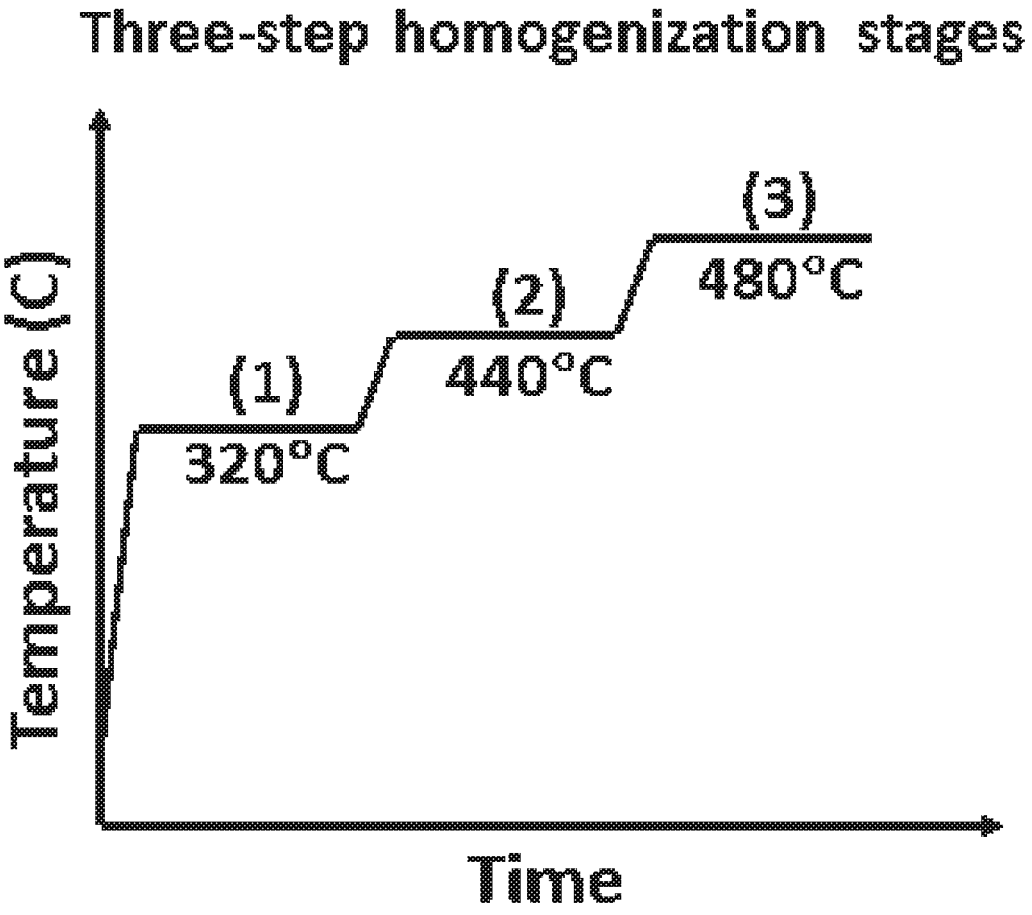
FIG. 3 is a schematic diagram of the multi-stage solution heat treatment schedule for ZAXEM11100.
Figure 4:
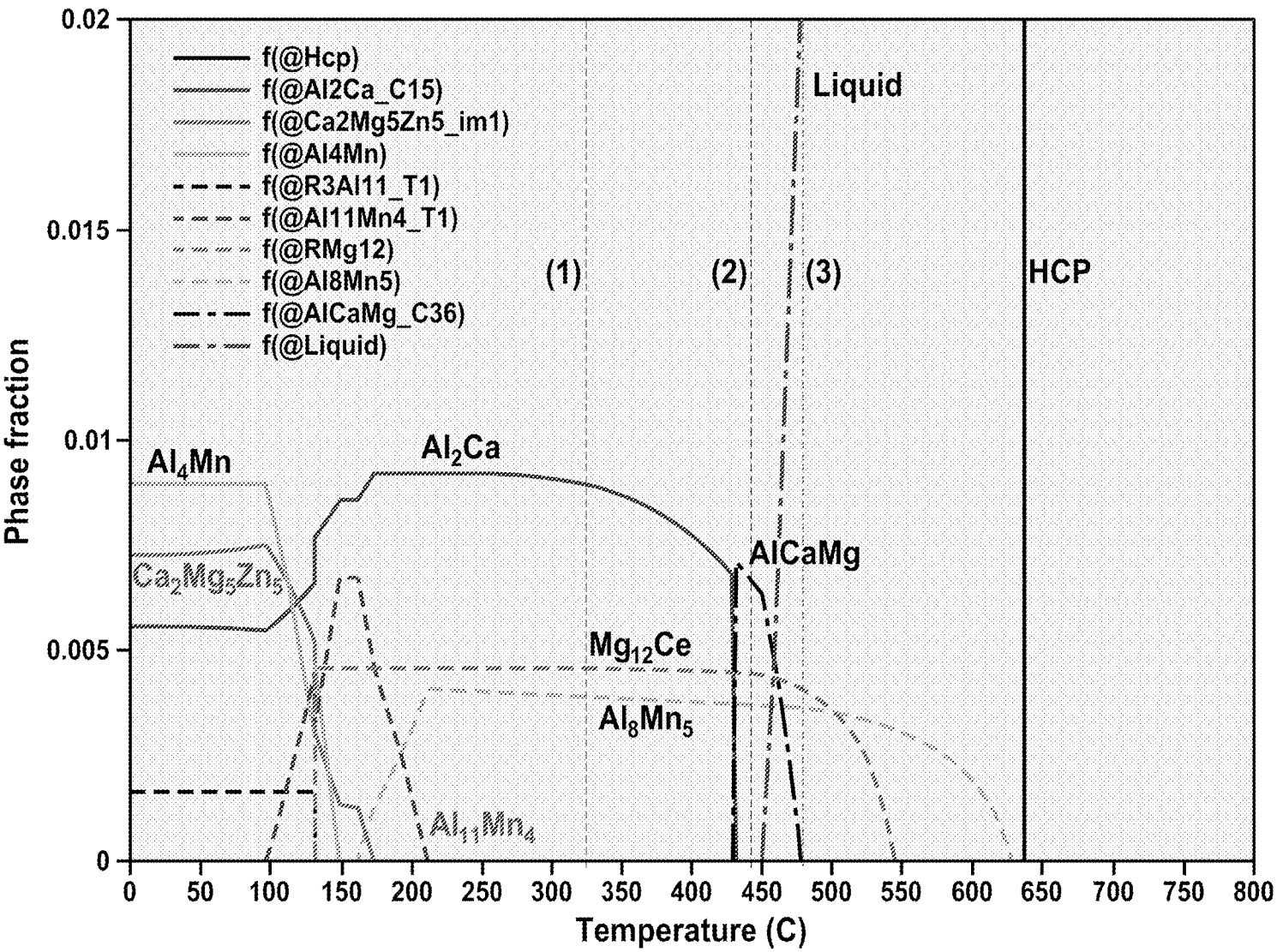
FIG. 4 is a phase fraction vs. temperature plot for ZAXEM11100 where (1), (20< and (3) refer to the three temperatures of the multi-stage solution heat treatment schedule shown in FIG. 3.
Figure 5:
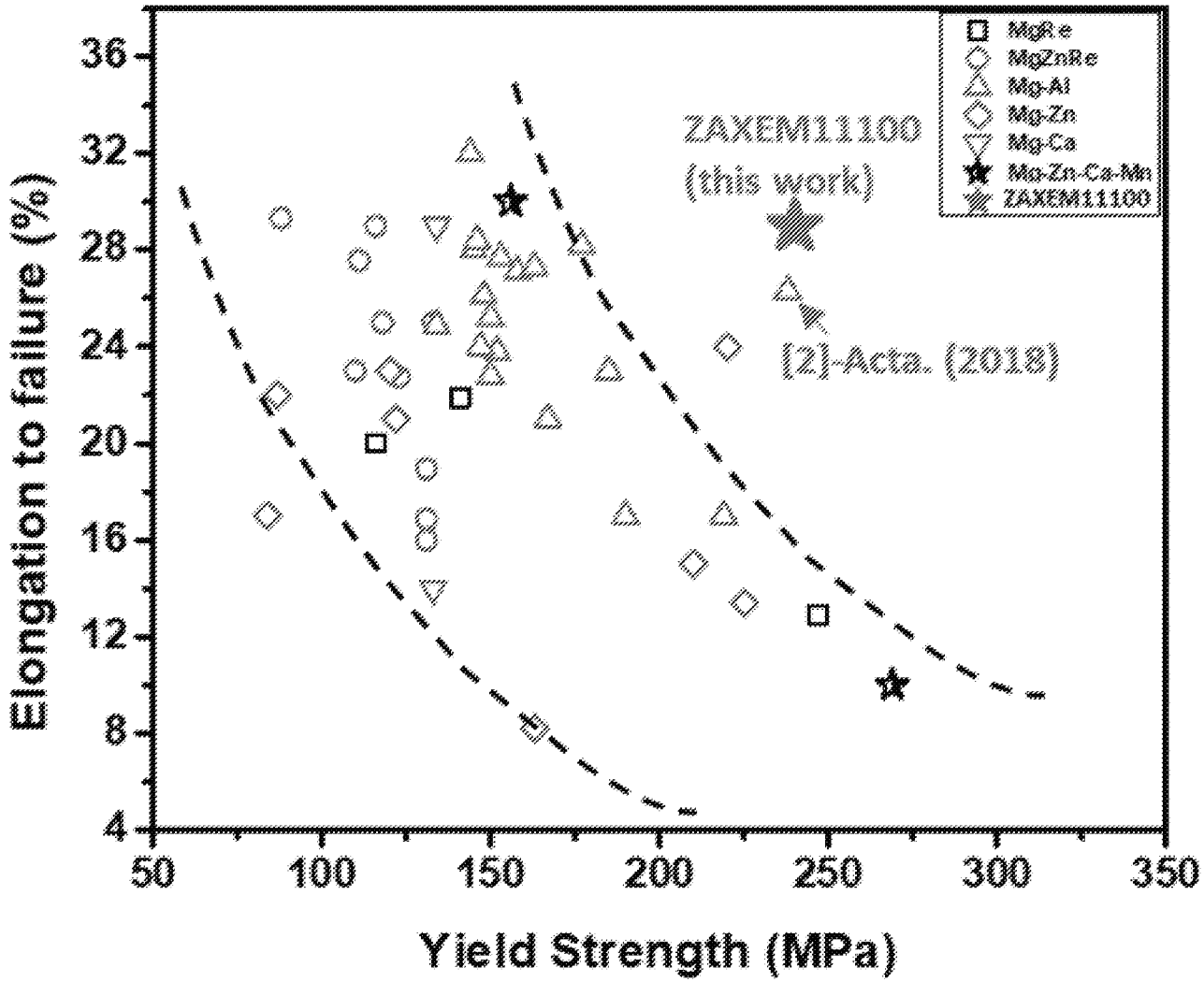
FIG. 5 is a plot of the yield strength vs. elongation for ZAXEM11100.
Figure 6:
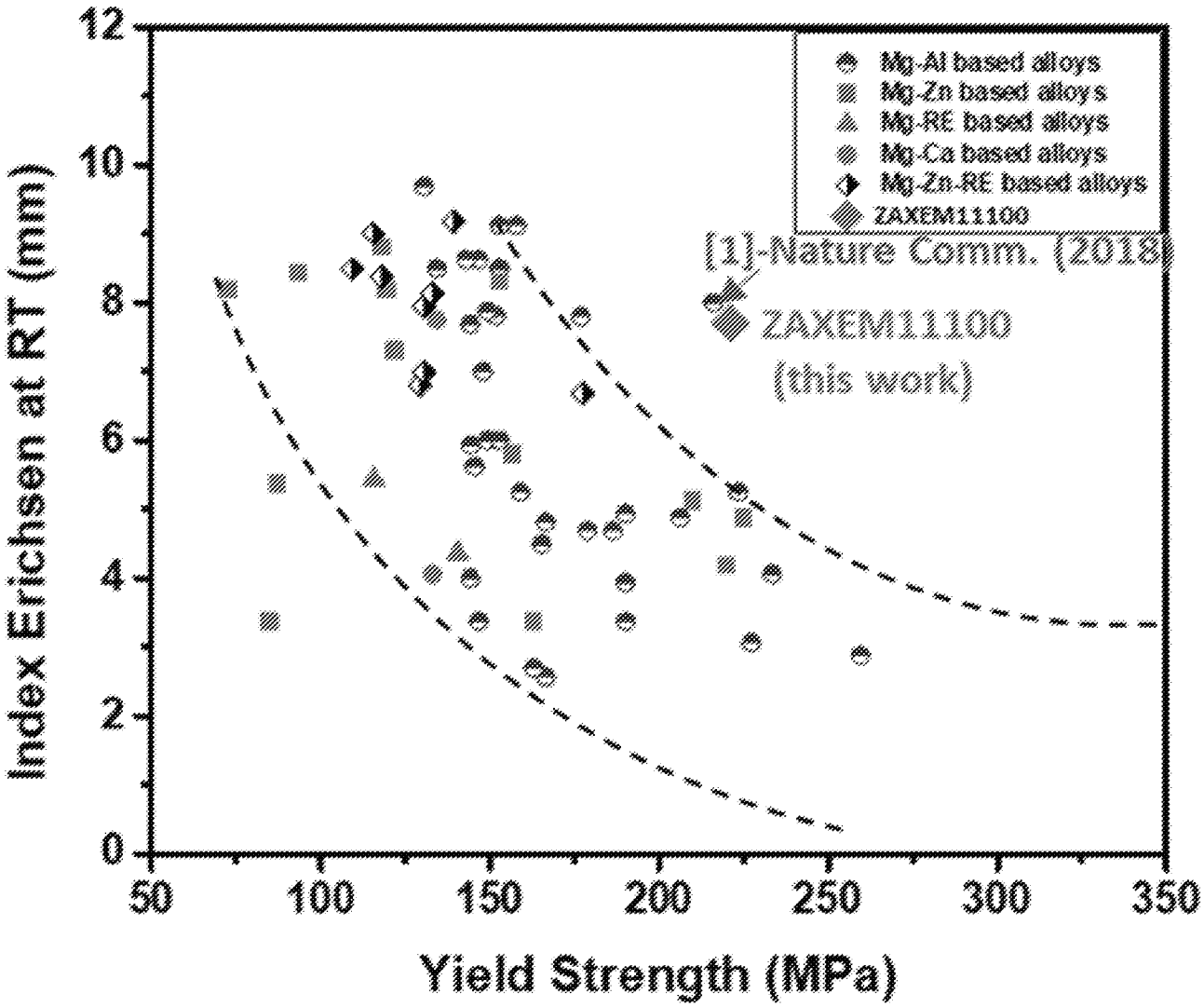
FIG. 6 is a plot of the yield strength vs. Index Erichsen value for ZAXEM11100.

The compositions, methods, and systems described herein may be understood more readily by reference to the following detailed description of specific aspects of the disclosed subject matter and the Examples included therein.

Before the present compositions, methods, and systems are disclosed and described, it is to be understood that the aspects described below are not limited to specific synthetic methods or specific reagents, as such may, of course, vary. It is also to be understood that the terminology used herein is for the purpose of describing particular aspects only and is not intended to be limiting.

Also, throughout this specification, various publications are referenced. The disclosures of these publications in their entireties are hereby incorporated by reference into this application in order to more fully describe the state of the art to which the disclosed matter pertains. The references disclosed are also individually and specifically incorporated by reference herein for the material contained in them that is discussed in the sentence in which the reference is relied upon.

In this specification and in the claims that follow, reference will be made to a number of terms, which shall be defined to have the following meanings.

Throughout the description and claims of this specification the word "comprise" and other forms of the word, such as "comprising" and "comprises," means including but not limited to, and is not intended to exclude, for example, other additives, components, integers, or steps.

As used in the description and the appended claims, the singular forms "a," "an," and "the" include plural referents unless the context clearly dictates otherwise. Thus, for example, reference to "a composition" includes mixtures of two or more such compositions, reference to "an agent" includes mixtures of two or more such agents, reference to "the component" includes mixtures of two or more such components, and the like.

"Optional" or "optionally" means that the subsequently described event or circumstance can or cannot occur, and that the description includes instances where the event or circumstance occurs and instances where it does not.

Ranges can be expressed herein as from "about" one particular value, and/or to "about" another particular value. By "about" is meant within 5% of the value, e.g., within 4, 3, 2, or 1% of the value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

It is understood that throughout this specification the identifiers "first" and "second" are used solely to aid in distinguishing the various components and steps of the disclosed subject matter. The identifiers "first" and "second" are not intended to imply any particular order, amount, preference, or importance to the components or steps modified by these terms.

References in the specification and concluding claims to parts by weight of a particular element or component in a composition denotes the weight relationship between the element or component and any other elements or components in the composition or article for which a part by weight is expressed. Thus, in a compound containing 2 parts by weight of component X and 5 parts by weight component Y, X and Y are present at a weight ratio of 2:5, and are present in such ratio regardless of whether additional components are contained in the compound.

A weight percent (wt. %) of a component, unless specifically stated to the contrary, is based on the total weight of the formulation or composition in which the component is included.

Disclosed herein are magnesium alloys comprising Zn, Al, Ca, Ce, Mn, and Mg. The Zn, Al, Ca, Ce, and Mn can, in some examples, be substantially dissolved in the magnesium alloy. In some examples, the magnesium alloy is microalloyed. The magnesium alloy can, for example, comprise from 1 to 1.5 wt. % Zn, from 1 to 1.4 wt. % Al, from 0.2 to 0.7 wt. % Ca, from 0.2 to 0.4 wt. % Ce, from 0.1 to 0.8 wt. % Mn, and the balance comprising Mg.

The magnesium alloy can, for example, comprise 1 wt. % or more Zn (e.g., 1.05 wt. % or more, 1.1 wt. % or more, 1.15 wt. or more, 1.2 wt. % or more, 1.25 wt. % or more, 1.3 wt. % or more, 1.35 wt. % or more, or 1.4 wt. % or more). In some examples, the magnesium alloy can comprise 1.5 wt. % or less Zn (e.g., 1.45 wt. % or less, 1.4 wt. % or less, 1.35 wt. % or less, 1.3 wt. % or less, 1.25 wt. % or less, 1.2 wt. % or less, 1.15 wt. % or less, 1.1 wt. % or less, or 1.05 wt. % or less). The amount of Zn in the magnesium alloy can range from any of the minimum values described above to any of the maximum values described above. For example, the magnesium alloy can comprise from 1 to 1.5 wt. % Zn (e.g., from 1 wt. % to 1.45 wt. %, from 1 wt. % to 1.25 wt. %, from 1 wt. % to 1.15 wt. %, or from 1 wt. % to 1.05 wt. %). In some examples, the magnesium alloy can comprise 1 wt. % Zn.

The magnesium alloy can, for example, can comprise 1 wt. % or more Al (e.g., 1.05 wt. % or more, 1.1 wt. % or more, 1.15 wt. % or more, 1.2 wt. % or more, 1.25 wt. % or more, or 1.3 wt. % or more). In some examples, the magnesium alloy can comprise 1.4 wt. % or less Al (e.g., 1.35 wt. % or less, 1.3 wt. % or less, 1.25 wt. % or less, 1.2 wt. % or less, 1.15 wt. % or less, 1.1 wt. % or less, or 1.05 wt. % or less). The amount of Al in the magnesium alloy can range from any of the minimum values described above to any of the maximum values described above. For example, the magnesium alloy can comprise from 1 to 1.4 wt. % Al (e.g., from 1 wt. % to 1.3 wt. %, from 1 wt. % to 1.2 wt. %, or from 1 wt. % to 1.1 wt. %). In some examples, the magnesium alloy can comprise 1 wt. %/0 Al.

The magnesium alloy can, for example, comprise 0.2 wt. % or more Ca (e.g., 0.25 wt. % or more, 0.3 wt. % or more, 0.35 wt. % or more, 0.4 wt. % or more, 0.45 wt. % or more, 0.5 wt. % or more, 0.55 wt. % or more, or 0.6 wt. % or more). In some examples, the magnesium alloy can comprise 0.7 wt. % or less Ca (e.g., 0.65 wt. % or less, 0.6 wt. % or less, 0.55 wt. % or less, 0.5 wt. % or less, 0.45 wt. % or less, 0.4 wt. % or less, 0.35 wt. % or less, 0.3 wt. % or less, or 0.25 wt. % or less). The amount of Ca in the magnesium alloy can range from any of the minimum values described above to any of the maximum values described above. For example, the magnesium alloy can comprise from 0.2 to 0.7 wt. % Ca (e.g., from 0.2 wt. % to 0.6 wt. %, from 0.2 wt. % to 0.5 wt. %, or from 0.2 wt. % to 0.4 wt. %). In some examples, the magnesium alloy can comprise 0.3 wt. % Ca.

The magnesium alloy can, for example, comprise 0.2 wt. % or more Ce (e.g., 0.25 wt. % or more, 0.3 wt. % or more, or 0.35 wt. % or more). In some examples, the magnesium alloy can comprise 0.4 wt. % or less Ce (e.g., 0.35 wt. % or less, 0.3 wt. % or less, or 0.25 wt. % or less).

The amount of Ce in the magnesium alloy can range from any of the minimum values described above to any of the maximum values described above. For example, the magnesium alloy can comprise from 0.2 to 0.4 wt. % Ce (e.g., from 0.2 wt. % to 0.35 wt. %, from 0.2 wt. % to 0.3 wt. %, or from 0.2 wt. % to 0.25 wt. %). In some examples, the magnesium alloy can comprise 0.2 wt. % Ce.

The magnesium alloy can, for example, comprise 0.1 wt. % or more Mn (e.g., 0.15 wt. % or more, 0.2 wt. % or more, 0.25 wt. % or more, 0.3 wt. % or more, 0.35 wt. % or more, 0.4 wt. % or more, 0.45 wt. % or more, 0.5 wt. % or more, 0.55 wt. % or more, 0.6 wt. % or more, 0.65 wt. % or more, or 0.7 wt. % or more). In some examples, the magnesium alloy can comprise 0.8 wt. % or less Mn (e.g., 0.75 wt. % or less, 0.7 wt. % or less, 0.65 wt. % or less, 0.6 wt. % or less, 0.55 wt. % or less, 0.5 wt. % or less, 0.45 wt. % or less, 0.4 wt. % or less, 0.35 wt. % or less, 0.3 wt. % or less, 0.25 wt. % or less, 0.2 wt. % or less, or 0.15 wt. % or less). The amount of Mn in the magnesium alloy can range from any of the minimum values described above to any of the maximum values described above. For example, the magnesium alloy can comprise from 0.1 to 0.8 wt. % Mn (e.g., from 0.15 wt. % to 0.75 wt. %, from 0.2 wt. % to 0.6 wt. %, or from 0.3 wt. % to 0.5 wt. %). In some examples, the magnesium alloy comprises 0.4 wt. % Mn.

The magnesium alloy, can, for example, from 1 to 1.25 wt. % Zn, from 1 to 1.2 wt. % Al, from 0.2 to 0.5 wt. % Ca, from 0.2 to 0.3 wt. % Ce, from 0.2 to 0.6 wt. % Mn, and the balance comprising Mg. In some examples, the magnesium alloy comprises 1 wt. % Zn, 1 wt. % Al, 0.3 wt. % Ca, 0.2 wt. % Ce, 0.4 wt. % Mn, and the balance comprising Mg.

The magnesium alloys described herein can have a high strength. For example, the magnesium alloy can have a yield strength of 200 MPa or more (e.g., 205 MPa or more, 210 MPa or more, 215 MPa or more, 220 MPa or more, 225 MPa or more, 230 MPa or more, 235 MPa or more, 240 MPa or more, 245 MPa or more, 250 MPa or more, 260 MPa or more, 270 MPa or more, or 275 MPa or more). Yield strength can be determined using methods known in the art, for example ASTM test standard, ASTM E8/E8M-16a Standard Test Methods for Tension Testing of Metallic Materials. As used herein, the strength is determined by measurement on a Tensile frame (MTS brand Criterion Model 43) with a laser extensometer (EIR Le-01); the machine produced a Stress vs. Strain plot that includes yield stress, Ultimate Tensile stress, and amount of strain at fracture which can be converted to ductility.

The magnesium alloys described herein can have a high ductility. For example, the magnesium alloy can have an elongation to failure of 25% or more (e.g., 26% or more, 27% or more, 28% or more, 29% or more, 30% or more, 31% or more, 32% or more, 33% or more, 34% or more, or 35% or more). Ductility can be determined using methods known in the art. As used herein, the ductility is determined by measurement on a Tensile frame (MTS brand Criterion Model 43) with a laser extensometer (EIR Le-01); the machine produced a Stress vs. Strain plot that includes yield stress, Ultimate Tensile stress, and amount of strain at fracture which can be converted to ductility. The magnesium alloys described herein can be formable at room temperature. As used herein, room temperature is meant to include temperatures of 20-30° C. For example, the magnesium alloy can have an Index Erichsen value of 6 mm or more (e.g., 7 mm or more, 8 mm or more, 9 mm or more, or 10 mm or more) at room temperature. Erichsen cupping tests can be performed using methods known in the art, for example ISO 20482, 2003. As used herein, Erichsen cupping tests were carried out on rectangular specimens using a hemispherical punch with a diameter of 20 mm at room temperature. Punch speed and blank-holder force were ~5.6 mm/min and 10 kN, respectively. The graphite lubrication was used on the tool.

The magnesium alloy can, for example, have an average grain size of 5 micrometers (microns, μm) or more (e.g., 5.5 μm or more, 6 μm or more, 6.5 μm or more, 7 μm or more, 7.5 μm or more, 8 μm or more, 8.5 μm or more, 9 μm or more, 9.5 μm or more, 10 μm or more, 10.5 μm or more, 11 μm or more, 11.5 μm or more, 12 μm or more, 12.5 μm or more, or 13 μm or more). In some examples, the magnesium alloy can have an average grain size of 14 μm or less (e.g., 13.5 μm or less, 13 μm or less, 12.5 μm or less, 12 μm or less, 11.5 μm or less, 11 μm or less, 10.5 μm or less, 10 μm or less, 9.5 μm or less, 9 μm or less, 8.5 μm or less, 8 μm or less, 7.5 μm or less, 7 μm or less, 6.5 μm or less, or 6 μm or less). The average grain size of the magnesium alloy can range from any of the minimum values described above to any of the maximum values described above. For example, the magnesium alloy can have an average grain size of from 5 μm to 14 μm (e.g., from 5 μm to 9.5 μm, from 9.5 μm to 14 μm, from 5 μm to 8 μm, from 8 μm to 11 μm, from 11 μm to 14 μm, from 5 μm to 12 μm, from 7 μm to 14 μm, or from 7 μm to 12 μm). Grain size can be determined using methods known in the art. As used herein, average grain size is measured using ASTM Standard E112-13, section 12, General intercept method.

Also described herein are sheets comprising any of the magnesium alloys described herein (e.g., magnesium alloy sheets). In some examples, the magnesium alloy sheets can have an average thickness of 0.5 millimeters (mm) or more (e.g., 0.6 mm or more, 0.7 mm or more, 0.8 mm or more, 0.9 mm or more, 1.0 mm or more, 1.1 mm or more, 1.2 mm or more, 1.3 mm or more, 1.4 mm or more, 1.5 mm or more, 1.6 mm or more, 1.7 mm or more, 1.8 mm or more, 1.9 mm or more, 2.0 mm or more, 2.5 mm or more, 3 mm or more, 3.5 mm or more, or 4 mm or more). In some examples, the magnesium alloy sheets can have an average thickness of 5 mm or less (e.g., 4.5 mm or less, 4 mm or less, 3.5 mm or less, 3 mm or less, 2.5 mm or less, 2 mm or less, 1.9 mm or less, 1.8 mm or less, 1.7 mm or less, 1.6 mm or less, 1.5 mm or less, 1.4 mm or less, 1.3 mm or less, 1.2 mm or less, 1.1 mm or less, 1.0 mm or less, 0.9 mm or less, 0.8 mm or less, or 0.7 mm or less). The average thickness of the magnesium alloy sheets can range from any of the minimum values described above to any of the maximum values described above. For example, the magnesium alloy sheets can have an average thickness of from 0.5 mm to 5 mm (e.g., from 0.5 mm to 4 mm, from 0.5 mm to 3 mm, from 0.5 mm to 2.5 mm, from 0.5 mm to 2 mm, from 0.8 mm to 2 mm, or from 0.8 mm to 1.5 mm).

Also described herein are objects and articles of manufacture comprising any of the magnesium alloys described herein. Also described herein are methods of use of the magnesium alloys, objects, sheets, and articles of manufacture described herein, the methods comprising using the magnesium alloys, objects, sheets, or articles of manufacture in an automotive, aerospace, or electronic application. Also described herein are methods of use of the magnesium alloys described herein, the methods comprising using the magnesium alloys in plate, forging and extraction applications, e.g., for a variety of industries.

Also described herein are methods of making a magnesium alloy based object comprising any of the magnesium alloys described herein, the method comprising heating an object comprising a preliminary magnesium alloy. The term "preliminary magnesium alloy" is used herein to refer to a magnesium alloy before it has undergone a heat treatment as disclosed herein. It is not meant to imply that the preliminary magnesium alloy is not yet a magnesium alloy (e.g., a metal element). Rather, a preliminary magnesium alloy is meant to refer to a magnesium alloy that has intermetallic phases present (e.g., 2 or more intermetallic phases, 3 or more intermetallic phases, etc.). In some examples, the preliminary magnesium alloy comprises a first intermetallic phase, a second intermetallic phase, a third intermetallic phase, and an alloy phase. "Phase," as used herein, generally refers to a region of a material which is a distinct and physically separate portion of a heterogeneous system. The term "phase" does not imply that the material making up a phase is a chemically pure substance, but merely that the chemical and/or physical properties of the material making up the phase are essentially uniform throughout the material, and that these chemical and/or physical properties differ significantly from the chemical and/or physical properties of another phase within the material. Examples of physical properties include density, thickness, aspect ratio, specific surface area, porosity, dimensionality, and melting temperature. Examples of chemical properties include chemical composition. In some examples, the first intermetallic phase can comprise a plurality of intermetallic compounds wherein each of the plurality of intermetallic compounds have a melting temperature that is distinct from the melting temperature of the second intermetallic phase, the melting temperature of the third intermetallic phase, and the solidus temperature. In some examples, the first intermetallic phase can comprise a plurality of intermetallic compounds wherein each of the plurality of intermetallic compounds have a melting temperature that is substantially the same.

In some examples, the first intermetallic phase can comprise $Al_4Mn$, $Ca_2Mg_5Zn_5$, $Al_{11}Mn_4$, or a combination thereof. In some examples, the second intermetallic phase comprises A12Ca. In some examples, the third intermetallic phase comprises AlCaMg.

The first intermetallic phase has a melting temperature, the second intermetallic phase has a melting temperature, the third intermetallic phase has a melting temperature, and the alloy phase having a solidus temperature; wherein the melting temperature of the first intermetallic phase is lower than the melting temperature of the second intermetallic phase, the melting temperature of the third intermetallic phase, and the solidus temperature of the alloy phase; wherein the melting temperature of the second intermetallic phase is lower than the melting temperature of the third intermetallic phase and the solidus temperature of the alloy phase; and wherein the melting temperature of the third intermetallic phase is higher than the solidus temperature of the alloy phase. The methods disclosed herein can comprise heating an object comprising a preliminary magnesium alloy at a first temperature for a first amount of time; wherein the first temperature is above the melting temperature of the first intermetallic phase, below the melting temperature of the second intermetallic phase, below the melting temperature of the third intermetallic phase, and below the solidus temperature of the alloy phase.

The first temperature can, for example, be above the melting temperature of the first intermetallic phase by 10° C. or more (e.g., 20° C. or more, 30° C. or more, 40° C. or more, 50° C. or more, 60° C. or more, 70° C. or more, 80° C. or more, 90° C. or more, 100° C. or more, 110° C. or more, 120° C. or more, 130° C. or more, 140° C. or more, 150° C. or more, 160° C. or more, 170° C. or more, or 180° C. or more). In some examples, the first temperature can be above the melting temperature of the first intermetallic phase by 200° C. or less (e.g., 190° C. or less, 180° C. or less, 170° C. or less, 160° C. or less, 150° C. or less, 140° C. or less, 130° C. or less, 120° C. or less, 110° C. or less, 100° C. or less, 90° C. or less, 80° C. or less, 70° C. or less, 60° C. or less, 50° C. or less, 40° C. or less, or 30° C. or less). The first temperature can be above the melting temperature of the first intermetallic phase by an amount that ranges from any of the minimum values described above to any of the maximum values described above. For example, the first temperature can be from 10° C. to 200° C. above the melting temperature of the first intermetallic phase (e.g., from 10° C. to 100° C., from 100° C. to 200° C., from 10° C. to 50° C., from 50° C. to 100° C., from 100° C. to 150° C., from 150° C. to 200° C., from 10° C. to 190° C., from 20° C. to 200° C., or from 20° C. to 190° C.).

In some examples, the first temperature can be 250° C. or more (e.g., 255° C. or more, 260° C. or more, 265° C. or more, 270° C. or more, 275° C. or more, 280° C. or more, 285° C. or more, 290° C. or more, 295° C. or more, 300° C. or more, 305° C. or more, 310° C. or more, 315° C. or more, or 320° C. or more). In some examples, the first temperature can be 325° C. or less (e.g., 320° C. or less, 315° C. or less, 310° C. or less, 305° C. or less, 300° C. or less, 295° C. or less, 290° C. or less, 285° C. or less, 280° C. or less, 275° C. or less, 270° C. or less, 265° C. or less, 260° C. or less, or 255° C. or less). The first temperature can range from any of the minimum values described above to any of the maximum values described above. For example, the first temperature can be from 250° C. to 325° C. (e.g., from 275° C. to 325° C., from 300° C. to 325° C., or from 315° C. to 325° C.). In some examples, the first temperature is 320° C.

The first amount of time can, for example, be 1 hour or more (e.g., 2 hours or more, 3 hours or more, 4 hours or more, 5 hours or more, 6 hours or more, 7 hours or more, 8 hours or more, 9 hours or more, 10 hours or more, 11 hours or more, 12 hours or more, 13 hours or more, 14 hours or more, 15 hours or more, 16 hours or more, 17 hours or more, 18 hours or more, 19 hours or more, 20 hours or more, 21 hours or more, 22 hours or more, or 23 hours or more). In some examples, the first amount of time can be 24 hours or less (e.g., 23 hours or less, 22 hours or less, 21 hours or less, 20 hours or less, 19 hours or less, 18 hours or less, 17 hours or less, 16 hours or less, 15 hours or less, 14 hours or less, 13 hours or less, 12 hours or less, 11 hours or less, 10 hours or less, 9 hours or less, 8 hours or less, 7 hours or less, 6 hours or less, 5 hours or less, 4 hours or less, or 3 hours or less). The first amount of time can range from any of the minimum values described above to any of the maximum values described above. For example, the first amount of time can be from 1 hour to 24 hours (e.g., from 1 hour to 12 hours, from 12 hours to 24 hours, from 1 hour to 6 hours, from 6 hours to 12 hours, from 12 hours to 18 hours, from 18 hours to 24 hours, from 1 hour to 18 hours, from 3 hours to 24 hours, from 2 hours to 20 hours, from 3 hours to 8 hours, or from 4 hours to 16 hours).

The first temperature and/or the first amount of time can be selected in view of a variety of factors. For example, the first temperature and the first amount of time can be selected such that heating the object comprising the preliminary magnesium alloy at the first temperature for the first amount of time substantially dissolves the first intermetallic phase into the alloy phase. In some examples, the methods can further comprise determining the first temperature and/or the first amount of time at which to heat the object comprising the preliminary magnesium alloy to thereby substantially dissolve the first intermetallic phase into the alloy phase.

The methods disclosed herein comprise heating the object comprising a preliminary magnesium alloy at a first temperature for a first amount of time; wherein the first temperature is above the melting temperature of the first intermetallic phase, below the melting temperature of the second intermetallic phase, below the melting temperature of the third intermetallic phase, and below the solidus temperature of the alloy phase; thereby substantially dissolving the first intermetallic phase into the alloy phase to form an object comprising a first intermediate magnesium alloy, the first intermediate magnesium alloy comprising the second intermetallic phase, the third intermetallic phase, and the alloy phase. The methods further comprise heating the object comprising the first intermediate magnesium alloy at a second temperature for a second amount of time; wherein the second temperature is above the melting temperature of the second intermetallic phase, below the melting temperature of the third intermetallic phase, and below the solidus temperature of the alloy phase.

The second temperature can, for example, be above the melting temperature of the second intermetallic phase by 10° C. or more (e.g., 20° C. or more, 30° C. or more, 40° C. or more, 50° C. or more, 60° C. or more, 70° C. or more, 80° C. or more, 90° C. or more, or 100° C. or more). In some examples, the second temperature can be above the melting temperature of the second intermetallic phase by 120° C. or less (e.g., 110° C. or less, 100° C. or less, 90° C. or less, 80° C. or less, 70° C. or less, 60° C. or less, 50° C. or less, 40° C. or less, or 30° C. or less). The second temperature can be above the melting temperature of the second intermetallic phase by an amount that range from any of the minimum values described above to any of the maximum values described above. For example, the second temperature can be from 10° C. to 120° C. above the melting temperature of the second intermetallic phase (e.g., from 10° C. to 60° C., from 60° C. to 120° C., from 10° C. to 40° C., from 40° C. to 80° C. from 80° C. to 120° C., from 10° C. to 100° C., from 20° C. to 120° C., or from 20° C. to 100° C.).

In some examples, the second temperature can be 325° C. or more (e.g., 330° C. or more, 340° C. or more, 350° C. or more, 360° C. or more, 370° C. or more, 380° C. or more, 390° C. or more, 400° C. or more, 410° C. or more, 420° C. or more, 430° C. or more, or 440° C. or more). In some examples, the second temperature can be 450° C. or less (e.g., 440° C. or less, 430° C. or less, 420° C. or less, 410° C. or less, 400° C. or less, 390° C. or less, 380° C. or less, 370° C. or less, 360° C. or less, 350° C. or less, 340° C. or less, or 330° C. or less). The second temperature can range from any of the minimum values described above to any of the maximum values described above. For example, the second temperature can be from 325° C. to 450° C. (e.g., from 350° C. to 450° C., from 380° C. to 450° C., from 400° C. to 450° C., or from 430° C. to 450° C.). In some examples, the second temperature is 440° C.

The second amount of time can, for example, be 1 hour or more (e.g., 2 hours or more, 3 hours or more, 4 hours or more, 5 hours or more, 6 hours or more, 7 hours or more, 8 hours or more, 9 hours or more, 10 hours or more, 11 hours or more, 12 hours or more, 13 hours or more, 14 hours or more, 15 hours or more, 16 hours or more, 17 hours or more, 18 hours or more, 19 hours or more, 20 hours or more, 21 hours or more, 22 hours or more, or 23 hours or more). In some examples, the second amount of time can be 24 hours or less (e.g., 23 hours or less, 22 hours or less, 21 hours or less, 20 hours or less, 19 hours or less, 18 hours or less, 17 hours or less, 16 hours or less, 15 hours or less, 14 hours or less, 13 hours or less, 12 hours or less, 11 hours or less, 10 hours or less, 9 hours or less, 8 hours or less, 7 hours or less, 6 hours or less, 5 hours or less, 4 hours or less, or 3 hours or less). The second amount of time can range from any of the minimum values described above to any of the maximum values described above. For example, the second amount of time can be from 1 hour to 24 hours (e.g., from 1 hour to 12 hours, from 12 hours to 24 hours, from 1 hour to 6 hours, from 6 hours to 12 hours, from 12 hours to 18 hours, from 18 hours to 24 hours, from 1 hour to 18 hours, from 3 hours to 24 hours, from 2 hours to 20 hours, from 3 hours to 8 hours, or from 4 hours to 16 hours).

The second temperature and/or the second amount of time can be selected in view of a variety of factors. For example, the second temperature and the second amount of time can be selected such that heating the object comprising the first intermediate magnesium alloy at the second temperature for the second amount of time substantially dissolves the second intermetallic phase into the alloy phase. In some examples, the methods can further comprise determining the second temperature and/or the second amount of time at which to heat the object comprising the first intermediate magnesium alloy to thereby substantially dissolve the second intermetallic phase into the alloy phase.

The methods described herein comprise heating the object comprising the first intermediate magnesium alloy at a second temperature for a second amount of time; wherein the second temperature is above the melting temperature of the second intermetallic phase, below the melting temperature of the third intermetallic phase, and below the solidus temperature of the alloy phase; thereby substantially dissolving the second intermetallic phase into the alloy phase to form an object comprising a second intermediate magnesium alloy, the second intermediate magnesium alloy comprising the third intermetallic phase and the alloy phase. The methods further comprise heating the object comprising the second intermediate magnesium alloy at a third temperature for a third amount of time, wherein the third temperature is above the melting temperature of the third intermetallic phase.

The third temperature can, for example, be above the melting temperature of the third intermetallic phase by 10° C. or more (e.g., 15° C. or more, 20° C. or more, 25° C. or more, 30° C. or more, 35° C. or more, or 40° C. or more). In some examples, the third temperature can be above the melting temperature of the third intermetallic phase by 50° C. or less (e.g., 45° C. or less, 40° C. or less, 35° C. or less, 30° C. or less, 25° C. or less, or 20° C. or less). The third temperature can be above the melting temperature of the third intermetallic phase by an amount that ranges from any of the minimum values described above to any of the maximum values described above. For example, the third temperature can be from 10° C. to 50° C. above the melting temperature of the third intermetallic phase (e.g., from 10° C. to 30° C., from 30° C. to 50° C., from 10° C. to 20° C., from 20° C. to 30° C., from 30° C. to 40° C., from 40° C. to 50° C., from 10° C. to 40° C., from 20° C. to 50° C., or from 20° C. to 40° C.).

In some examples, the third temperature can be 450° C. or more (e.g., 455° C. or more, 460° C. or more, 465° C. or more, 470° C. or more, 475° C. or more, 480° C. or more, 485° C. or more, 490° C. or more, or 495° C. or more). In some examples, the third temperature can be 500° C. or less (e.g., 495° C. or less, 490° C. or less, 485° C. or less, 480° C. or less, 475° C. or less, 470° C. or less, 465° C. or less, 460° C. or less, or 455° C. or less). The third temperature can range from any of the minimum values described above to any of the maximum values described above. For example, the third temperature can be from 450° C. to 500° C. (e.g., from 460° C. to 500° C., from 470° C. to 490° C., or from 475° C. to 485° C.). In some examples, the third temperature is 480° C.

The third amount of time can, for example, be 0.1 hours or more (e.g., 0.2 hours or more, 0.3 hours or more, 0.4 hours or more, 0.5 hours or more, 0.6 hours or more, 0.7 hours or more, 0.8 hours or more, 0.9 hours or more, 1 hours or more, 1.1 hours or more, 1.2 hours or more, 1.3 hours or more, 1.4 hours or more, 1.5 hours or more, 1.6 hours or more, 1.7 hours or more, 1.8 hours or more, 1.9 hours or more, 2 hours or more, 2.2 hours or more, 2.4 hours or more, or 2.6 hours or more). In some examples, the third amount of time can be 3 hours or less (e.g., 2.8 hours or less, 2.6 hours or less, 2.4 hours or less, 2.2 hours or less, 2 hours or less, 1.9 hours or less, 1.8 hours or less, 1.7 hours or less, 1.6 hours or less, 1.5 hours or less, 1.4 hours or less, 1.3 hours or less, 1.2 hours or less, 1.1 hours or less, 1 hours or less, 0.9 hours or less, 0.8 hours or less, 0.7 hours or less, 0.6 hours or less, 0.5 hours or less, 0.4 hours or less, or 0.3 hours or less). The third amount of time can range from any of the minimum values described above to any of the maximum values described above. For example, the third amount of time can be from 0.1 hours to 3 hours (e.g., from 0.1 hours to 1.5 hours, from 1.5 hours to 3 hours, from 0.1 hours to 1 hour, from 1 hour to 2 hours, from 2 hours to 3 hours, from 0.1 hours to 2.4 hours, from 0.2 hours to 2.2 hours, or from 0.3 hours to 2 hours).

The third temperature and/or the third amount of time can be selected in view of a variety of factors. For example the third temperature and the third amount of time can be selected such that heating the object comprising the second intermediate magnesium alloy at the third temperature for the third amount of time substantially dissolves the third intermetallic phase into the alloy phase and minimizes incipient melting of the alloy phase. In some examples, the methods can further comprise determining the third temperature and/or the third amount of time at which to heat the object comprising the second intermediate magnesium alloy to thereby substantially dissolve the third intermetallic phase into the alloy phase and minimize incipient melting of the alloy phase.

The methods further comprise heating the object comprising the second intermediate magnesium alloy at a third temperature for a third amount of time; wherein the third temperature is above the melting temperature of the third intermetallic phase; thereby substantially dissolving the third intermetallic phase into the alloy phase and minimizing incipient melting of the alloy phase to form the magnesium alloy based object. As used herein "minimizing" incipient melting of the alloy phase means that 5% or less of the alloy phase melts (e.g., 4.5% or less, 4% or less, 3.5% or less, 3% or less, 2.5% or less, 2% or less, 1.5% or less, 1% or less, 0.5% or less, or 0.1% or less). In some examples, the magnesium alloy based object can comprise a substantially homogeneous matrix comprising the alloy phase.

In some examples, the methods can further comprise thermomechanically treating the magnesium alloy based object by heating the magnesium alloy based object at a fourth temperature for a fourth amount of time and, subsequently, mechanically treating the magnesium alloy based object. In some examples, mechanically treating the magnesium alloy based object comprises rolling the magnesium alloy based object, extrusion, forging (e.g., open-die forging and/or closed-die forging), or a combination thereof. In some examples, mechanically treating the magnesium alloy based object comprises rolling the magnesium alloy based object. In some examples, mechanically treating the magnesium alloy based object comprises extrusion. In some examples, mechanically treating the magnesium alloy based object comprises forging (e.g., open-die forging and/or closed-die forging). In some examples, the methods can further comprise repeating the thermomechanical treatment.

The fourth amount of time can, for example, be 1 minute or more 1 minute or more (e.g., 2 minutes or more, 3 minutes or more, 4 minutes or more, 5 minutes or more, 6 minutes or more, 7 minutes or more, 8 minutes or more, 9 minutes or more, 10 minutes or more, 11 minutes or more, 12 minutes or more, 13 minutes or more, 14 minutes or more, 15 minutes or more, 16 minutes or more, 17 minutes or more, 18 minutes or more, 19 minutes or more, 20 minutes or more, 25 minutes or more, 30 minutes or more, 35 minutes or more, 40 minutes or more, 45 minutes or more, or 50 minutes or more). In some examples, the fourth amount of time can be 1 hour or less (e.g., 55 minutes or less, 50 minutes or less, 45 minutes or less, 40 minutes or less, 35 minutes or less, 30 minutes or less, 25 minutes or less, 20 minutes or less, 19 minutes or less, 18 minutes or less, 17 minutes or less, 16 minutes or less, 15 minutes or less, 14 minutes or less, 13 minutes or less, 12 minutes or less, 11 minutes or less, 10 minutes or less, 9 minutes or less, 8 minutes or less, 7 minutes or less, 6 minutes or less, 5 minutes or less, 4 minutes or less 3 minutes or less, or 2 minutes or less). The fourth amount of time can range from any of the minimum values described above to any of the maximum values described above. For example, the fourth amount of time can be from 1 minute to 1 hour (e.g., from 1 minute to 30 minutes, from 1 minute to 60 minutes, from 1 minute to 20 minutes, from 20 minutes to 40 minutes, from 40 minutes to 60 minutes, from 1 minute to 50 minutes, from 1 minute to 40 minutes, from 1 minute to 30 minutes, from 1 minute to 20 minutes, or from 1 minute to 10 minutes). In some examples, the fourth amount of time is 5 minutes.

The fourth temperature can, for example, be above room temperature and below the solidus temperature. In some examples, the fourth temperature can be below the solidus temperature by 10° C. or more (e.g., 20° C. or more, 30° C. or more, 40° C. or more, 50° C. or more, 60° C. or more, 70° C. or more, 80° C. or more, 90° C. or more, 100° C. or more, 110° C. or more, 120° C. or more, 130° C. or more, 140° C. or more, 150° C. or more, 160° C. or more, 170° C. or more, 180° C. or more, 190° C. or more, 200° C. or more, 210° C. or more, 220° C. or more, or 230° C. or more). In some examples, the fourth temperature can be below the solidus temperature by 250° C. or less (e.g., 240° C. or less, 230° C. or less, 220° C. or less, 210° C. or less, 200° C. or less, 190° C. or less, 180° C. or less, 170° C. or less, 160° C. or less, 150° C. or less, 140° C. or less, 130° C. or less, 120° C. or less, 110° C. or less, 100° C. or less, 90° C. or less, 80° C. or less, 70° C. or less, 60° C. or less, 50° C. or less, 40° C. or less, or 30° C. or less). The fourth temperature can be below the solidus temperature by an amount that range from any of the minimum values described above to any of the maximum values described above. For example, the fourth temperature can be from 10° C. to 250° C. below the solidus temperature (e.g., from 10° C. to 130° C., from 130° C. to 250° C., from 10° C. to 50° C., from 50° C. to 100° C., from 100° C. to 150° C., from 150° C. to 200° C., from 200° C. to 250° C., from 10° C. to 200° C., from 20° C. to 250° C., or from 20° C. to 200° C.).

The fourth temperature can, for example, be 350° C. or more (e.g., 360° C. or more, 370° C. or more, 380° C. or more, 390° C. or more, 400° C. or more, 410° C. or more, 420° C. or more, 430° C. or more, 440° C. or more, 450° C. or more, 460° C. or more, 470° C. or more, 480° C. or more, 490° C. or more, 500° C. or more, 510° C. or more, 520° C. or more, or 530° C. or more). In some examples, the fourth temperature can be 550° C. or less (e.g., 540° C. or less, 530° C. or less, 520° C. or less, 510° C. or less, 500° C. or less, 490° C. or less, 480° C. or less, 470° C. or less, 460° C. or less, 450° C. or less, 440° C. or less, 430° C. or less, 420° C. or less, 410° C. or less, 400° C. or less, 390° C. or less, 380° C. or less, or 370° C. or less). The fourth temperature can range from any of the minimum values described above to any of the maximum values described above. For example, the fourth temperature can be from 350° C. to 550° C. (e.g., from 350° C. to 450° C., from 450° C. to 550° C., from 350° C. to 400° C., from 400° C. to 450° C., from 450° C. to 500° C., from 500° C. to 550° C., from 400° C. to 550° C., from 350° C. to 500° C., from 400° C. to 500° C., or from 440° C. to 460° C.). In some examples, the fourth temperature is 450° C.

In some examples, the methods can further comprise determining the fourth temperature and/or the fourth amount of time.

In some examples, mechanically treating the magnesium alloy based object comprises rolling the magnesium alloy based object. For example, the magnesium alloy based object can have an average thickness and rolling the magnesium alloy based object reduces the average thickness of the magnesium alloy based object.

In some examples, rolling the magnesium alloy based object can reduce the average thickness of the magnesium alloy based object by 1% or more (e.g., 2% or more, 3% or more, 4% or more, 5% or more, 10% or more, 15% or more, 20% or more, 25% or more, 30% or more, 35% or more, 40% or more, 45% or more, 50% or more, 55% or more, 60% or more, 65% or more, 70% or more, or 75% or more). In some examples, rolling the magnesium alloy based object can reduce the average thickness of the magnesium alloy based object by 85% or less (e.g., 80% or less, 75% or less, 70% or less, 65% or less, 60% or less, 55% or less, 50% or less, 45% or less, 40% or less, 35% or less, 30% or less, 25% or less, 20% or less, 15% or less, 10% or less, 9% or less, 8% or less, 7% or less, 6% or less, or 5% or less). Rolling the magnesium alloy based object can reduce the average thickness of the magnesium alloy based object by an amount that range from any of the minimum values described above to any of the maximum values described above. For example, rolling the magnesium alloy based object can reduce the average thickness of the magnesium alloy based object by from 1% to 85% (e.g., from 1% to 40%, from 40% to 85%, from 1% to 30%, from 30% to 60%, from 60% to 85%, from 5% to 85%, from 1% to 80%, or from 5% to 80%).

In some examples, the magnesium alloy based object exhibits improved mechanical properties (e.g., improved yield strength and/or ductility) after thermomechanical treatment.

In some examples, the methods can further comprise determining the first temperature, the first amount of time, the second temperature, the second amount of time, the third temperature, the third amount of time, the fourth temperature, the fourth amount of time, or a combination thereof. For example, determining the first temperature, the first amount of time, the second temperature, the second amount of time, the third temperature, the third amount of time, or a combination thereof can be carried out in whole or in part on one or more computing device(s).

In some examples, the methods can further comprise casting the object comprising the preliminary magnesium alloy. In some examples, the methods can further comprise determining the composition of the preliminary magnesium alloy and/or the magnesium alloy. For example, the composition of the preliminary magnesium alloy and/or the magnesium alloy can be based on the characteristics of the alloying elements to provide the maximum benefit of each alloying element to the alloy. For example, the methods can further comprise determining the amount of Zn to include in the magnesium alloy, the amount of Al to include in the magnesium alloy, the amount of Ca to include in the magnesium alloy, the amount of Ce to include in the magnesium alloy, the amount of Mn to include in the magnesium alloy, or a combination thereof. For example, determining the amount of Zn to include in the magnesium alloy, the amount of Al to include in the magnesium alloy, the amount of Ca to include in the magnesium alloy, the amount of Ce to include in the magnesium alloy, the amount of Mn to include in the magnesium alloy, or a combination thereof can be carried out in whole or in part on one or more computing device(s). For example, the methods can further comprise optimizing the addition of each alloying element to achieve the best performance via controlling solute concentration and precipitates in magnesium matrix.

Also disclosed herein are magnesium alloy based objects made by any of the methods described herein. In some examples, the magnesium alloy based objects can comprise a substantially homogeneous matrix comprising the alloy phase.

In some examples, the magnesium alloy based object exhibits a yield strength of 200 MPa or more (e.g., 205 MPa or more, 210 MPa or more, 215 MPa or more, 220 MPa or more, 225 MPa or more, 230 MPa or more, 235 MPa or more, 240 MPa or more, 245 MPa or more, 250 MPa or more, 260 MPa or more, 270 MPa or more, or 275 MPa or more). Yield strength can be determined using methods known in the art, for example ASTM test standard, ASTM E8/E8M-16a Standard Test Methods for Tension Testing of Metallic Materials. As used herein, the strength is determined by measurement on a Tensile frame (MTS brand Criterion Model 43) with a laser extensometer (EIR Le-01); the machine produced a Stress vs. Strain plot that includes yield stress, Ultimate Tensile stress, and amount of strain at fracture which can be converted to ductility.

In some examples, the magnesium alloy an elongation to failure of 25% or more (e.g., 26% or more, 27% or more, 28% or more, 29% or more, 30% or more, 31% or more, 32% or more, 33% or more, 34% or more, or 35% or more). Ductility can be determined using methods known in the art. As used herein, the ductility is determined by measurement on a Tensile frame (MTS brand Criterion Model 43) with a laser extensometer (EIR Le-01); the machine produced a Stress vs. Strain plot that includes yield stress, Ultimate Tensile stress, and amount of strain at fracture which can be converted to ductility.

In some examples, the magnesium alloy based object has an Index Erichsen value of 6 mm or more (e.g., 7 mm or more, 8 mm or more, 9 mm or more, or 10 mm or more) at room temperature. Erichsen cupping tests can be performed using methods known in the art, for example ISO 20482, 2003. As used herein, Erichsen cupping tests were carried out on rectangular specimens using a hemispherical punch with a diameter of 20 mm at room temperature. Punch speed and blank-holder force were ~5.6 mm/min and 10 kN, respectively. The graphite lubrication was used on the tool.

In some examples the magnesium alloy based object can have an average thickness of 0.5 millimeters (mm) or more (e.g., 0.6 mm or more, 0.7 mm or more, 0.8 mm or more, 0.9 mm or more, 1.0 mm or more, 1.1 mm or more, 1.2 mm or more, 1.3 mm or more, 1.4 mm or more, 1.5 mm or more, 1.6 mm or more, 1.7 mm or more, 1.8 mm or more, 1.9 mm or more, 2.0 mm or more, 2.5 mm or more, 3 mm or more, 3.5 mm or more, or 4 mm or more). In some examples, the magnesium alloy based object can have an average thickness of 5 mm or less (e.g., 4.5 mm or less, 4 mm or less, 3.5 mm or less, 3 mm or less, 2.5 mm or less, 2 mm or less, 1.9 mm or less, 1.8 mm or less, 1.7 mm or less, 1.6 mm or less, 1.5 mm or less, 1.4 mm or less, 1.3 mm or less, 1.2 mm or less, 1.1 mm or less, 1.0 mm or less, 0.9 mm or less, 0.8 mm or less, or 0.7 mm or less). The average thickness of the magnesium alloy based object can range from any of the minimum values described above to any of the maximum values described above. For example, the magnesium alloy based object can have an average thickness of from 0.5 mm to 5 mm (e.g., from 0.5 mm to 4 mm, from 0.5 mm to 3 mm, from 0.5 mm to 2.5 mm, from 0.5 mm to 2 mm, from 0.8 mm to 2 mm, or from 0.8 mm to 1.5 mm).

The magnesium alloy based object can, for example, have an average grain size of 5 micrometers (microns, μm) or more (e.g., 5.5 μm or more, 6 μm or more, 6.5 μm or more, 7 μm or more, 7.5 μm or more, 8 μm or more, 8.5 μm or more, 9 μm or more, 9.5 μm or more, 10 μm or more, 10.5 μm or more, 11 μm or more, 11.5 μm or more, 12 μm or more, 12.5 μm or more, or 13 μm or more). In some examples, the magnesium alloy based object can have an average grain size of 14 μm or less (e.g., 13.5 μm or less, 13 μm or less, 12.5 μm or less, 12 μm or less, 11.5 μm or less, 11 μm or less, 10.5 μm or less, 10 μm or less, 9.5 μm or less, 9 μm or less, 8.5 μm or less, 8 μm or less, 7.5 μm or less, 7 μm or less, 6.5 μm or less, or 6 μm or less). The average grain size of the magnesium alloy based object can range from any of the minimum values described above to any of the maximum values described above. For example, the magnesium alloy based object can have an average grain size of from 5 μm to 14 μm (e.g., from 5 μm to 9.5 μm, from 9.5 μm to 14 μm, from 5 μm to 8 μm, from 8 μm to 11 μm, from 11 μm to 14 μm, from 5 μm to 12 μm, from 7 μm to 14 μm, or from 7 μm to 12 μm). Grain size can be determined using methods known in the art. As used herein, average grain size is measured using ASTM Standard E112-13, section 12, General intercept method.

Also described herein are methods of use of the magnesium alloy based objects described herein, the methods comprising using the magnesium alloy based object in an automotive, aerospace, or electronic application. Also described herein are articles of manufacture comprising the magnesium alloy based objects described herein. Also described herein are methods of use of the magnesium alloys described herein, the methods comprising using the magnesium alloys in plate, forging and extraction applications, e.g., for a variety of industries A number of embodiments of the invention have been described. Nevertheless, it will be understood that various modifications may be made without departing from the spirit and scope of the invention. Accordingly, other embodiments are within the scope of the following claims.

The examples below are intended to further illustrate certain aspects of the systems and methods described herein, and are not intended to limit the scope of the claims.

EXAMPLES

The following examples are set forth below to illustrate the methods and results according to the disclosed subject matter. These examples are not intended to be inclusive of all aspects of the subject matter disclosed herein, but rather to illustrate representative methods and results. These examples are not intended to exclude equivalents and variations of the present invention which are apparent to one skilled in the art.

Efforts have been made to ensure accuracy with respect to numbers (e.g., amounts, temperature, etc.) but some errors and deviations should be accounted for. Unless indicated otherwise, parts are parts by weight, temperature is in ° C. or is at ambient temperature, and pressure is at or near atmospheric. There are numerous variations and combinations of measurement conditions, e.g., component concentrations, temperatures, pressures and other measurement ranges and conditions that can be used to optimize the described process.

Example 1

Described herein are magnesium alloys, for example the magnesium alloy ZAXEM11100 (Mg-1Zn-1Al-0.3Ca-0.2Ce-0.4Mn). The design of the magnesium alloy ZAXEM11100 (Mg-1Zn-1Al-0.3Ca-0.2Ce-0.4Mn) was based on the characteristics of alloying elements and CALPHAD (CALculation of PHAse Diagrams) simulation, to provide the maximum benefit of each alloying element. Additions of zinc (Zn), aluminum (Al), calcium (Ca), and manganese (Mn) can improve the strength of Mg alloys via solid solution strengthening (Luo, *International Materials Reviews* 2013, 49(1), 13-30; Luo et al. *Scr. Mater.* 2011, 64, 410-413), precipitation strengthening (Sasaki et al. *Acta Mater.* 2015, 99, 176-186; Zeng et al. *Acta Mater.* 2018, 160, 97-108; Bian et al. *Scr. Mater.* 2017, 138, 151-155), grain boundary strength (Zeng et al. *Acta Mater.* 2018, 160, 97-108), and grain refinement strengthening (Xu et al. Scr. Mater. 2011, 65, 269-272); and also improve ductility or formability via weakening the strong basal texture of Mg alloys (Bian et al. Scr. Mater. 2017, 138, 151-155; Zeng et al. *Acta Mater.* 2016, 105, 479-494; Zhang et al. *Scr. Mater.* 2010, 63, 1024-1027; Robson et al. *Acta Mater.* 2009, 57, 2739-2747). Cerium (Ce) can improve the strength and ductility of wrought Mg alloy via a number of mechanisms including texture randomization (Luo et al. Scr. Mater. 2011, 64, 410-413), reduced intrinsic stacking fault energy (Sandlöbes et al. *Acta Mater.* 2012, 60, 3011-3021) and lower critical resolved shear stress (CRSS) of pyramidal <c+a>slip (Liu et al. *Acta Mater.* 2017, 141, 1-9). CALPHAD method (Luo, *CALPHAD,* 2015, 50, 6-22) was used to optimize the addition of each alloying element to achieve the best performance via controlling solute concentration and precipitates in magnesium matrix.

Thermomechanical processing (TMP), including homogenization, rolling, and annealing, can be important in maximizing the alloying effects for final mechanical properties in the magnesium alloy. Conventional homogenization process (at below solidus temperature of the alloy to avoid incipient melting) is inefficient in maximizing solute concentrations in Mg matrix and the dissolution of second phases from as-cast microstructure due to low diffusion coefficients of the alloying elements at low temperatures. CALPHAD simulation was also used to develop a new homogenization process (multiple isothermal stages with final stages at temperatures higher than the alloy solidus) for the magnesium alloy described herein, achieving complete dissolution of alloying elements without incipient melting (FIG. 1-4). The combination of the alloy design and TMP process provides an excellent combination of strength and ductility at room temperature for the magnesium alloys described herein.

Figure 7:
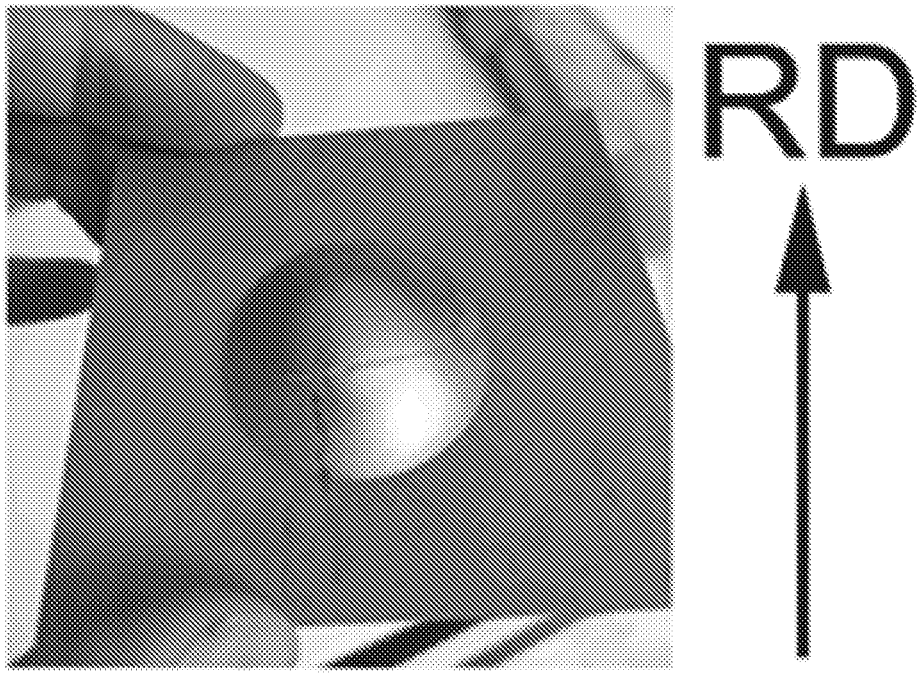
FIG. 7 is an image showing the formability of ZAXEM11100 at room temperature.
Figure 8:
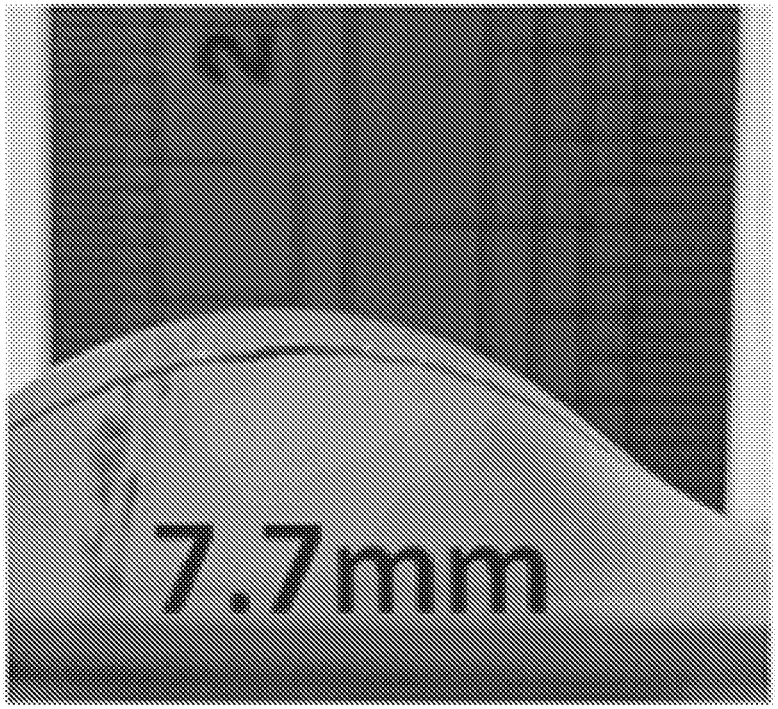
FIG. 8 is an image showing the formability of ZAXEM11100 at room temperature.

Longitudinal tensile samples with a gauge length of 12.5 mm, a gauge width of 5 mm, and a gauge thickness of 1 mm were machined from the as-rolled magnesium alloy sheets and then annealed at 350° C. for 1 h. The annealed tensile specimens were tested at a strain rate of $1.8\times10^{-4}$ $s^{-1}$. At least three specimens were tested at room temperature to ensure repeatability. Erichsen cupping tests were carried out on rectangular samples (60 mm×60 mm×1 mm), machined from the as-rolled magnesium alloy sheets and then annealed at 450° C. for 1 h. The punch diameter and speed used were 20 mm and 5.6 mm/min, respectively. A blank holder force was 10 kN and graphite was used as a lubricant. The mechanical properties and formability test at room temperature for the magnesium sheet alloy (ZAXEM11100) are shown in FIG. 5-FIG. 8. This sheet alloy can be stamped (press-formed) at room temperature (FIG. 7 and FIG. 8).

The magnesium sheet alloy (ZAXEM11100) described herein can be used for automotive, aerospace, and electronic industries, in which the excellent combination of high strength, high ductility, and good formability are required.

The magnesium alloy described herein is low cost because of room-temperature press-forming process and addition of alloying elements. The magnesium alloys described herein are lightweight compared with commercial aluminum alloys/steel. The magnesium alloys described herein exhibit an excellent combination of mechanical properties surpassing those of the existing magnesium sheet alloys reported so far.

Other advantages which are obvious and which are inherent to the invention will be evident to one skilled in the art. It will be understood that certain features and sub-combinations are of utility and may be employed without reference to other features and sub-combinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The methods of the appended claims are not limited in scope by the specific methods described herein, which are intended as illustrations of a few aspects of the claims and any methods that are functionally equivalent are intended to fall within the scope of the claims. Various modifications of the methods in addition to those shown and described herein are intended to fall within the scope of the appended claims. Further, while only certain representative method steps disclosed herein are specifically described, other combinations of the method steps also are intended to fall within the scope of the appended claims, even if not specifically recited. Thus, a combination of steps, elements, components, or constituents may be explicitly mentioned herein or less, however, other combinations of steps, elements, components, and constituents are included, even though not explicitly stated.

What is claimed is:

1. A magnesium alloy comprising:
from 1 to 1.25 wt. % Zn,
from 1 to 1.4 wt. % Al,
from 0.2 to 0.45 wt. % Ca,
from 0.2 to 0.4 wt. % Ce,
from 0.1 to 0.8 wt. % Mn, and
the balance comprising Mg.

2. The magnesium alloy of claim 1, wherein the magnesium alloy comprises from 1 to 1.2 wt. % Al.

3. The magnesium alloy of claim 1, wherein the magnesium alloy comprises from 0.2 to 0.4 wt. % Ca.

4. The magnesium alloy of claim 1, wherein the magnesium alloy comprises from 0.2 to 0.3 wt. % Ce.

5. The magnesium alloy of claim 1, wherein the magnesium alloy comprises from 0.2 to 0.6 wt. % Mn.

6. The magnesium alloy of claim 1, wherein the magnesium alloy comprises from 1 to 1.25 wt. % Zn, from 1 to 1.2 wt. % Al, from 0.2 to 0.45 wt. % Ca, from 0.2 to 0.3 wt. % Ce, from 0.2 to 0.6 wt. % Mn, and the balance comprising Mg.

7. The magnesium alloy of claim 1, wherein the Zn, Al, Ca, Ce, and Mn are substantially dissolved in the magnesium alloy.

8. The magnesium alloy of claim 1, wherein the magnesium alloy is microalloyed.

9. The magnesium alloy of claim 1, wherein the magnesium alloy has a yield strength of 200 MPa or more, an elongation to failure of 25% or more, or a combination thereof.

10. The magnesium alloy of claim 1, wherein the magnesium alloy has an Index Erichsen value of 6 mm or more at room temperature.

11. The magnesium alloy of claim 1, wherein the magnesium alloy has an average grain size of from 5 μm to 14 μm.

12. An object comprising the magnesium alloy of claim 1.

13. The object of claim 12, wherein the object comprises a sheet and the sheet has an average thickness of from 0.5 mm to 5 mm.

14. The magnesium alloy of claim 1, wherein the magnesium alloy has an elongation to failure of 25% or more.

15. The magnesium alloy of claim 1, wherein the magnesium alloy has an elongation to failure of 25% or more and a yield strength of 200 MPa or more.

16. The magnesium alloy of claim 1, wherein the magnesium alloy is substantially free of $Al_4Mn$, $Ca_2Mg_5Zn_5$, $Al_{11}Mn_4$, $Al_2Ca$, AlCaMg, or a combination thereof.

17. The magnesium alloy of claim 1, wherein the magnesium alloy is substantially free of $Al_2Ca$.

* * * * *